US006551424B1

(12) United States Patent
Haszler et al.

(10) Patent No.: US 6,551,424 B1
(45) Date of Patent: Apr. 22, 2003

(54) METHOD FOR THE MANUFACTURING OF AN ALUMINIUM-MAGNESIUM-LITHIUM ALLOY PRODUCT

(75) Inventors: Alfred Johann Peter Haszler, Vallendar (DE); Christian Joachim Keidel, Montabaur (DE)

(73) Assignee: Corus Aluminium Walzprodukte GmbH, Koblenz (DE)

( * ) Notice: Subject to any disclaimer, the term of this patent is extended or adjusted under 35 U.S.C. 154(b) by 0 days.

(21) Appl. No.: 09/868,042

(22) PCT Filed: Dec. 17, 1999

(86) PCT No.: PCT/EP99/10188

§ 371 (c)(1),
(2), (4) Date: Aug. 21, 2001

(87) PCT Pub. No.: WO00/37696

PCT Pub. Date: Jun. 29, 2000

(30) Foreign Application Priority Data

Dec. 18, 1998 (EP) ..... 98204310
Jan. 21, 1999 (EP) ..... 99200159

(51) Int. Cl.[7] ..... C22F 1/047

(52) U.S. Cl. ..... 148/552; 148/693; 148/697; 148/702

(58) Field of Search ..... 148/552, 693, 148/697, 702, 415

(56) References Cited

U.S. PATENT DOCUMENTS 5,439,536 A * 8/1995 Cho ..... 148/415

FOREIGN PATENT DOCUMENTS

| | | |
|---|---|---|
| DE | 1558491 | 3/1970 |
| GB | 2146353 | 4/1985 |

OTHER PUBLICATIONS

S.R. Lampman et al: "Metals Handbook, Edition 10, vol. 2, pp. 178–199" 1990, ASM International, Ohio USA XP002098817 Figure 5.

(List continued on next page.)

*Primary Examiner*—George Wyszomierski
*Assistant Examiner*—Janelle Combs-Morillo
(74) *Attorney, Agent, or Firm*—Stevens, Davis, Miller & Mosher, LLP

(57) ABSTRACT

Method for manufacturing of an aluminum-magnesium-lithium product, comprising the steps of subsequently: (a) providing an aluminum alloy consisting of (in weight %): Mg 3.0–6.0, Li 0.4–3.0, Zn up to 2.0, Mn up to 1.0, Ag up to 0.5, Fe up to 0.3, Si to 0.3, Cu up to 0.3, 0.02–0.5 selected from the group consisting of (Sc 0.010–0.40, Hf 0.010–0.25, Ti 0.010–0.25, V 0.010–0.30, Nd 0.010–0.20, Zr 0.020–0.25, Cr 0.020–0.25, Y 0.005–0.20, Be 0.0002–0.10), balance consisting essentially of aluminum and incidental elements and impurities; (b) casting the aluminum alloy into an ingot; (c) preheating the ingot; (d) hot rolling the pre-heated ingot to a hot worked intermediate product; (e) cold rolling the hot worked intermediate product to a rolled product in both the length and in the width direction with a total cold rolling reduction of at least 15%; (f) solution heat treating the cold rolled product in the temperature range of 465 to 565° C. for a soaking time in the range of 0.15 to 8 hours; (g) cooling the solution heat treated product from the solution heat treatment temperature to below 150° C. with a cooling rate of at least 0.2° C./sec; (h) ageing the cooled product to provide a sheet or thin plate product having a minimum yield strength of 260 MPa or more and a minimum tensile strength of 400 MPa or more in at least the L- and LT-direction, a minimum yield strength of 230 MPa or more and a minimum tensile strength of 380 MPa or more in the 45° to the L-direction, and further having a minimum T-L fracture toughness $K_{CO}$ of 80 MPa.√ or more for 400 mm wide CCT-panels.

13 Claims, 2 Drawing Sheets

FOREIGN PATENT DOCUMENTS

Figure 1:
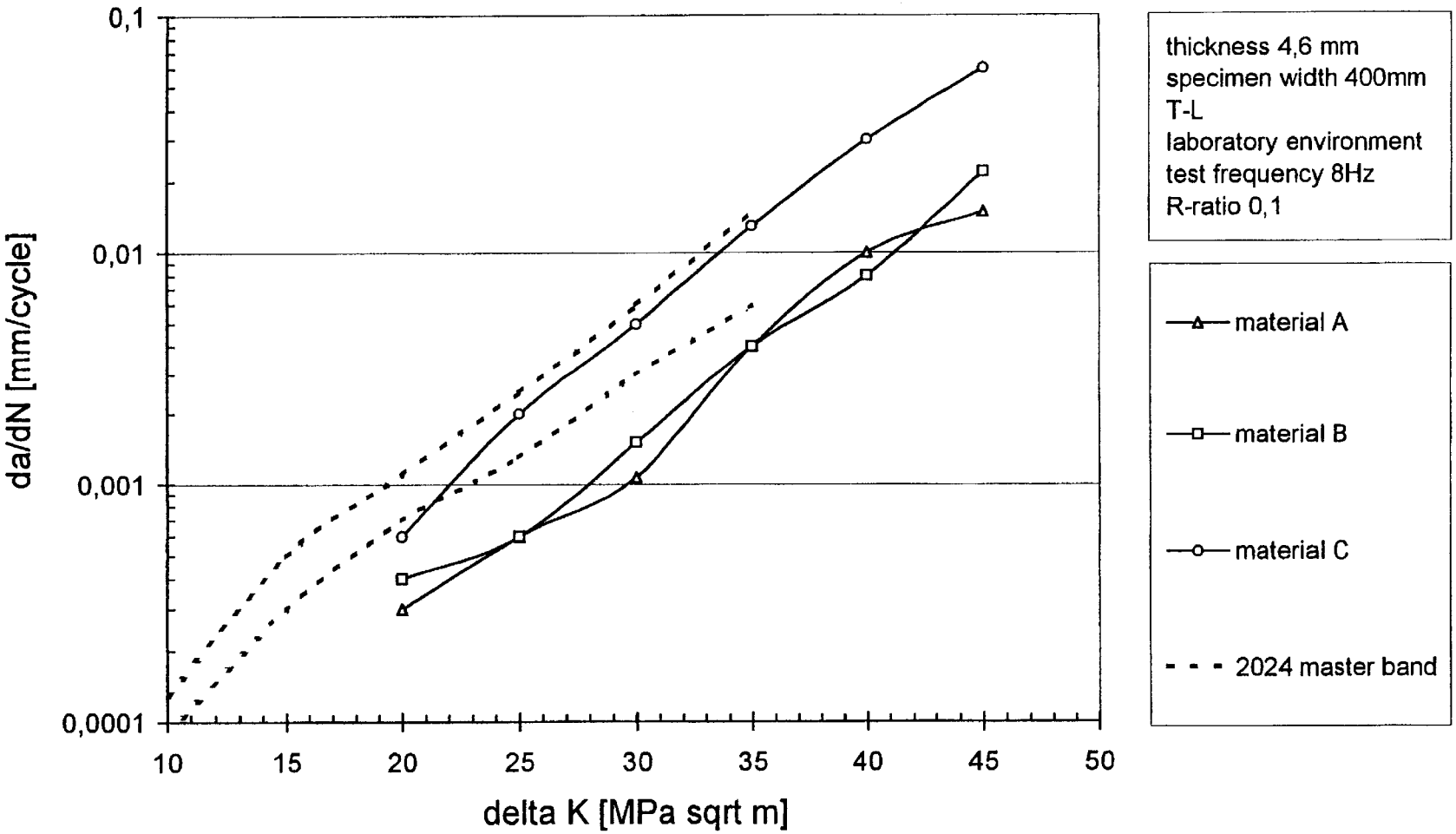

| | | | |
|---|---|---|---|
| WO | 9203583 | | 3/1992 |
| WO | WO 92/03583 | * | 3/1992 |
| WO | 9203586 | | 3/1992 |

OTHER PUBLICATIONS

T.H. Sanders et al: "Aluminium–Lithium Alloys II, Proc. Int. Aluminium–Lithium Conf. Monterey, CA, USA Apr. 12–14 1983." 1984, Met. Soc. IF Aime, US Warrendale XP002098818.

Patent Abstracts of Japan vol. 011, No. 069 (C–407), Mar. 3, 1987 & JP 61 227157 A (Kobe Steel Ltd), Oct. 9, 1986 cited in the application abstract.

* cited by examiner

METHOD FOR THE MANUFACTURING OF AN ALUMINIUM-MAGNESIUM-LITHIUM ALLOY PRODUCT

FIELD OF THE INVENTION

The invention relates to a method for the manufacturing of an aluminium-magnesium-lithium product with less anisotropy of mechanical properties, and further the invention relates to the use of the obtained product for structural components of aircraft.

For the purpose of this invention sheet material is to be understood as a rolled product having a thickness of not less than 1.3 mm (0.05 inch) and not more than 6.3 mm (0.25 inch). See also Aluminium Standards and Data, Aluminium Association, Chapter 5 Terminology, 1997. Thin plate material is to be understood as a rolled product having a thickness of not less than 6.3 mm and not more than 12 mm.

A cast ingot or slab is a three dimensional object having by definition a length (normally the casting direction in case of (semi)-continuous casting), a width and a thickness, whereby the width is equal to or larger than the thickness.

DESCRIPTION OF THE RELATED ART

It is well known that adding lithium as an alloying element to aluminium alloys results in beneficial mechanical properties. Aluminium-lithium alloys exhibit improvements in stiffness and strength while reducing density to a significant extent. Consequently, these types of alloys have utility as structural materials in aircraft and aerospace applications. Examples of known aluminium-lithium alloys include the British alloy AA8090, the American alloys AA2090 and AA2091, and the Russian alloy 01420.

Problems exist both with aluminium-lithium alloys and the aluminium-magnesium-lithium alloys, particularly in the anisotropy of mechanical properties and fracture toughness. Fracture toughness values in the T-L direction tend to be significantly lower than fracture toughness values in the main direction, viz. the L-T direction.

Some other disclosures of Al—Li alloys found in the prior art literature will be mentioned below.

WO-92/03583 proposes an alloy useful in aircraft and airframe structures which has low density. The composition is, in wt. %:

Mg 0.5–10.0, preferably 7.0–10.0

Li 0.5–3.0, preferably 1.0–1.5

Zn 0.1–5.0, preferably 0.3–1.0

Ag 0.1–2.0, preferably 0.3–1.0 balance aluminium, and with the proviso that the total amount of alloying elements does not exceed 12.0, and with the further proviso that when Mg ranges from 7.0 to 10.0, Li cannot exceed 2.5% and Zn cannot exceed 2.0%.

Said alloy includes a mandatory amount of silver. In order the manufacture rolled product of this aluminium alloy standard processing parameters have been applied.

GB-A-2146353 proposes an alloy having a high electrical resistance and an excellent formability, useful in structures suffering the action of high magnetic field, nuclear fusion reactors or the like. The composition is, in wt. %:

Mg 1.0–8.0, preferably 2.0–7.0

Li 0.05–1.0 at least one element selected from the group consisting of:

Ti 0.05–0.20
Cr 0.05–0.40
Zr 0.05–0.30

V 0.05–0.35
W 0.05–0.30
Mn 0.05–2.0 balance aluminium and incidental impurities.

Further, Bi in the range of 0.05 to 0.50 wt. % may be contained in this alloy. In order the manufacture rolled product of this aluminium alloy standard processing parameters have been applied.

DE-A-1558491 discloses the Russian alloy development for their 1420 alloy referenced above, the alloy contains, in wt. %:

Mg 4–7

Li 1.5–2.6

Zr 0.05–0.3 or alternatively Ti 0.05–0.15

Mn 0.2–1.0 balance aluminium and impurities.

JP-A-61227157 discloses an Al—Li and a method of its manufacture, the disclosed alloy consists of, in wt. %:

Li 1.0–5.0 one or more selected from the group consisting of:

Zr 0.05–0.3
Cr 0.05–0.3
Mn 0.05–1.5
V 0.05–0.3
Ti 0.005–0.1 balance aluminium

In order the manufacture rolled product of this aluminium alloy standard processing parameters have been applied.

SUMMARY OF THE INVENTION

In view of the drawbacks in aluminium-lithium alloys and in aluminium-magnesium-lithium alloys with respect to fracture toughness, a need has developed to provide a method of improving the T-L fracture toughness for these types of alloys. In response to this need, the present invention provides a method therefor which significantly increases the fracture toughness of aluminium-magnesium-lithium alloys in the T-L direction, thereby improving their suitability for more commercial applications, in particular for use as structural components in aircraft.

In accordance with the invention there is provided in a method for the manufacturing of an aluminium-magnesium-lithium product with less anisotropy of mechanical properties, comprising the steps of subsequently:

(a) providing an aluminium alloy consisting of (in weight %):

Mg 3.0–6.0
Li 0.4–3.0
Zn up to 2.0
Mn up to 1.0
Ag up to 0.5
Fe up to 0.3
Si up to 0.3
Cu up to 0.3
0.02–0.5 selected from the group consisting of (Sc 0.010–0.40, Hf 0.010–0.25, Ti 0.010–0.25, V 0.010–0.30, Nd 0.010–0.20, Zr 0.020–0.25, Cr 0.020–0.25, Y 0.005–0.20, and Be 0.0002–0.10), and balance consisting essentially of aluminium and incidental elements and impurities;

(b) casting the aluminium alloy into an ingot;

(c) preheating the ingot;

(d) hot rolling the preheated ingot to a hot worked intermediate product;

(e) cold rolling the hot worked intermediate product to a rolled product in both the length and in the width direction with a total cold rolling reduction of at least 15%;

(f) solution heat treating the cold rolled product in the temperature range of 465 to 565° C. for a soaking time in the range of 0.15 to 8 hours;

(g) cooling the solution heat treated product from the solution heat treating temperature to below 150° C. with a cooling rate of at least 0.2° C./sec;

(h) ageing the cooled product to provide a sheet or thin plate product having a minimum yield strength of 260 MPa or more and a minimum tensile strength of 400 MPa or more in at least the L- and LT-direction, a minimum yield strength of 230 MPa or more and a minimum tensile strength of 380 MPa or more in the 45° to the L-direction, and further having a minimum T-L fracture toughness $K_{CO}$ of 80 MPa.√m or more for 400 mm wide Centre Cracked Fracture Toughness testpanels (CCT-panels).

With the method in accordance with the invention it is now possible to provide a sheet product or a thin plate product of the indicated type having the mechanical properties as set out, which properties are much more isotropic than manufactured in a coil production route. In particular this method allows for an improvement of the relevant properties in the T-L direction of the obtained product. And a further advantage of this method is that it allows for the production of much wider sheet products, for example up to 2.5 meter wide, in comparison with conventional coil production routes.

In an embodiment of the method in accordance with the invention the obtained product may be provided with a cladding. Such clad products utilise a core of the aluminium-magnesium-lithium base alloy as set out in more detail below and a cladding on at least one side of the core, which cladding is usually of higher purity (higher percentage aluminium than in the core) and which, in particular, enhance appearance and corrosion protects the core. The cladding includes, but is not limited to, essentially unalloyed aluminium or aluminium containing not more than 0.1 or 1% of all other elements. Aluminium alloys herein designated 1xxx-type series include all Aluminium Association (AA) alloys, including the sub-classes of the 1000-type, 1100-type, 1200-type and 1300-type. In addition, AA alloy 7072 containing zinc (0.8 to 1.3%) can serve as the cladding and alloys of the AA6000-series alloys, such as 6003 or 6253, which contain typically more than 1% of alloying additions, can serve as cladding. Other alloys could also be useful as cladding as long as they provide in particular sufficient overall corrosion protection to the core alloy. The clad layer or layers are usually much thinner than the core, each constituting 0.5 to 15 or 20 or possibly 25% of the total composite thickness. A cladding layer more typically constitutes around 0.5 to 12% of the total composite thickness.

The preheating of the cast ingot prior to hot rolling is usually carried out at a temperature in the range of 360 to 500° C. in single or in multiple steps. In either case, preheating decreases the segregation of alloying elements in the material as cast and dissolves soluble elements, such as Li. If the treatment is carried out below 360° C., the resultant homogenisation effect is inadequate. Furthermore, due to substantial increase in deformation resistance of the ingot, industrial hot rolling is difficult for temperatures below 360° C. The preferred time of the above treatment is between 1 and 24 hours, preferably between 5 and 20 hours, and more preferably between 8 and 15 hours. Preferably the preheating is carried out at a temperature in the range of 400 to 470° C., more preferably of 410 to 450° C., and most preferably of 420 to 440° C.

Typically, prior to hot rolling the rolling faces of both the cladded and the non-cladded products are scalped in order to remove segregation zones near the cast surface of the ingot.

The hot rolling procedure of the method in accordance with the invention involves preferably hot rolling of the preheated ingot in both the length and width directions. During the hot rolling process rolling directions can be changed alternatively more than once. The hot rolling is preferably carried out in the temperature range of 270 to 470° C. It has been found beneficial for the properties of the final product if after the final hot rolling step the product has a temperature above 270° C., preferably above 300° C., and more preferably above 330° C. After the initial first hot rolling step the intermediate hot rolled product is preferably reheated to a temperature in the range of 360 to 470° C. for 1 to 24 hours, and more preferably in the range of 410 to 450° C., and most preferably of 420 to 440° C. A more preferred soak time is in the range of 5 to 20 hours and more preferably in the range of 7 to 15 hours. This reheat treatment is repeated for each following step of hot rolling until the desired intermediate gauge is obtained. Using this hot rolling practice a further improvement of the mechanical properties is obtained as is a more isotropic structure of the final product.

When necessary during the hot rolling process in accordance with the invention the intermediate product can be cut into sub-products as to allow for hot rolling in both the length and width directions.

Preferably the hot rolled intermediate product is annealed prior to cold rolling to enhance workability. The annealing treatment is preferably carried out at a temperature in the range of 360 to 470° C. and more preferably of 380 to 420° C. The soak time for annealing is in the range of 0.5 to 8 hours, and preferably of 0.5 to 3 hours. The annealed intermediate product is allowed to cool down to below 150° C., preferably by using air cooling.

To produce the rolled sheet product in accordance with the invention, the product is cold worked by means of cold rolling the product in both the length and in the width direction to the final desired product gauge, comprising a thickness reduction of at least 15%. A practical maximum thickness reduction during cold rolling is about 90% because of cracking of the sheet or thin plate without interanneal. Preferably the cold rolling degree is 20 to 50% at each step, and preferably 20 to 40% at each step. Using a cold rolling practice as set out above in particular an improvement in the reduction of anisotropy has been obtained in the mechanical properties, and more in particular a better balance has been obtained in the 45° to the L-direction for the yield strength, the tensile strength and the elongation.

During cold rolling the rolled product may be subjected to an interannealing treatment or intermediate annealing to improve workability of the cold rolled product. Interannealing is preferably carried out at a temperature in the range 300 to 500° C., more preferably of 350 to 450° C., and most preferably of 380 to 410° C. The soak time for interannealing is in the range of 0.5 to 8 hours, and preferably of 0.5 to 3 hours, after which the product is allowed to cool down by air cooling.

The cold rolled sheet product in accordance with the invention is then solution heat treated typically at a temperature in the range of 465 to 565° C., preferably of 490 to 540° C., for a soaking time in the range of 0.15 to 8 hours, preferably for a soaking time of 0.5 to 3 hours, and more preferably of 0.8 to 2 hours, during which the excessive phases dissolve to the maximum extent possible at that temperature.

To further provide for the desired strength and fracture toughness necessary to the final product and to the operations in forming that product, the product should be cooled to below 150° C. by using a cooling rate of at least 0.2° C./sec, and preferably a cooling rate of at least 1° C./sec, typically by means of fast air cooling. With the combination of the relatively high soaking temperature and relatively long soaking times and the indicated cooling rates an improvement is obtained in the desirable mechanical properties, in particular this treatment is beneficial for the fracture toughness $K_{CO}$ and for the elongation of the final product. It has also been found that the product obtained is essentially free from Type-A Lüder-lines. And further the thermal stability of the product obtained is improved.

After cooling the annealed product and prior to the artificial ageing the product may be stretched, preferably at room temperature, an amount not greater than 3% of its original length or otherwise worked or deformed to impart to the product a working effect equivalent to stretching not greater than 3% of its original length. Preferably the stretching is in a range of 0.3 to 2.5%, and more preferably of 0.5 to 1.5% of its original length. The working effect referred to is meant to include rolling and forging as well as other working operations. It has been found that by stretching the product of this invention the residual stresses therein are relieved and the flatness of the product is improved, and also the ageing response is improved.

A suitable artificial ageing process in the method according to this invention is giving in the international patent application no. WO-99/15708, which is being incorporated here by reference.

It should be mentioned here that a method is known from U.S. Pat. No. 4,151,013 to provide Al—Mg alloys sheets having magnesium in the range of 2 to 8% and the sheet being free from Type-A Lüder-lines after stretching, comprising the steps of:

(a) heating the sheet to a temperature in the range of 455–565° C., (850 to 1050° F.) preferably in the range of 480–510° C. (900 to 950° F.) for a soaking time of 0.5 to 10 minutes;

(b) cooling the sheet to below 175° C. (350° F.) with a predetermined cooling rate Q;

(c) stretching the sheet for 0.25 to 1% of its original length.

However, this document does not mention the use of this method for Al—Mg—Li alloys, and further it does not mention that with a longer soaking time in the range of 0.15 to 8 hours as set out in the method according to the present invention also the Type-A Lüder-lines can be avoided and further that an improvement in the values for the fracture toughness $K_{CO}$ and elongation of the final product may be obtained. Nor has it been mentioned that an improvement in the resistance to crack propagation can be obtained.

After the product has been worked and annealed, it may be aged to provide the combination of strength and fracture toughness and resistance to crack propagation which are so highly desired in aircraft members. The product may be naturally aged, typically at ambient temperatures, and alternatively the product may be artificially aged to provide the combination. This can be accomplished by subjecting the sheet or shaped product to a temperature in the range of 65 to 205° C. for a sufficient period of time to further increase the yield strength.

Further, it will be noted that the product formed in accordance with the invention may be subjected to any of the typical underageing treatments well known in the art. Also, while reference has been made herein to single ageing steps, multiple ageing steps, such as two or three ageing steps, are contemplated and stretching of its equivalent working may be used prior to or even after part of such multiple ageing steps.

In a preferred embodiment of the method in accordance with the invention the obtained product has a minimum T-L fracture toughness $K_{CO}$ of 90 MPa.√m or more for 400 mm wide CCT-panels, and more preferably of 95 MPa.√m or more. In American based literature $K_{CO}$ of an material is often referred to as $K_{app}$ or as apparent fracture toughness.

In a preferred embodiment of the method in accordance with the invention the obtained product has a minimum tensile strength of 430 MPa or more in at least the L- and LT-direction, and more preferably a minimum of 450 MPa or more in these indicated directions. The preferred minimum tensile strength in the 450 to the L-direction is 390 MPa or more, and more preferably 400 MPa or more.

In a preferred embodiment of the method in accordance with the invention the obtained product has a minimum yield strength of 300 MPa or more in at least the L- and LT-, direction, and more preferably a minimum of 315 MPa or more, and most preferably of 330 MPa or more in these indicated directions. The preferred minimum yield strength in the 45° to the L-direction is 250 MPa or more, and more preferably 260 MPa or more, and more preferably of 270 MPa or more.

In a further embodiment of the method in accordance with the invention the obtained product has a minimum yield strength of 400 MPa or more in the L-direction and a minimum yield strength of 370 MPa or more in the LT-direction and a minimum yield strength of 330 MPa or more in the 45° to the L-direction.

The reasons for the limitations of the alloying elements of the aluminium-magnesium-lithium based product obtained by the method according to the present invention are described below. All composition percentages are by weight.

Mg is the primary strengthening element in the product without increasing density. Mg levels below 3.0% do not provide the required strength and when the addition exceeds 6.0% severe cracking may occur during the casting and hot rolling of the product. The preferred level of Mg is between 4.3 to 5.5%, and more preferably of 4.7 to 5.3%, as a compromise between fabricability and strength.

Li is also an essential alloying element and to provide the product with a low density, high strength, good weldability, and a very good natural ageing response.

The preferred Li level is in the range of 1.0 to 2.2%, more preferably of 1.3 to 2.0%, and most preferably of 1.5 to 1.8%, as a comprise between fabricability and strength.

Zinc as an alloying element is may be present in the product according to this invention to provide improved precipitation hardening response and corrosion performance. Zinc levels above 1.5% do not provide good welding performance, and further increases density. The preferred level of zinc is 0.05–1.5%, and more preferably the level is between 0.2–1.0%.

Mn may be present in a range of up to 1.0%. The preferred level if Mn is in the range of 0.02 to 0.5%, and more preferably in the range of 0.02 to 0.25%. In these ranges the added manganese will aid to control the grain structure.

Cu is preferably not added to the product since it deteriorates corrosion resistance, although it is known that it can increase mechanical properties significantly. The Cu level should not exceed 0.3%, while a preferred maximum is 0.20%, and more preferably the maximum level is 0.05%.

Sc may be present in range of up to 0.4% to improve the strength of the product and to improve the weldability of the product by reducing hot crack sensitivity during welding, it will increase the recrystallisation temperature and improves the ability to control the grain structure. The preferred range is from 0.01% to 0.08%, and more preferably from 0.02 to 0.08%, as a compromise between strength and fabricability. Elements having similar effect, such as neodymium, cerium and yttrium, or mixtures thereof, can be used, either instead of, or in addition to, scandium, without changing the essence of the product according to this invention.

Zr is preferably added as a recrystallisation inhibitor and is preferably present in a range of 0.02 to 0.25%, more preferably in a range of 0.02 to 0.15%, and most preferably of 0.05 to 0.12%. Although other grain refiners can be used for aluminium-magnesium-lithium alloys, zirconium proved to be the most effective one for this type of alloys. Elements having similar effect, such as chromium, manganese, hafnium, titanium, boron, vanadium, titanium diboride, or mixtures thereof, can be used, either instead of, or in addition to, zirconium, without changing the essence of the product according to this invention.

The expensive alloying element silver, which is frequently used in this type of alloys, may be added. Although it can be added in the usual range of up to about 0.5%, and preferably in the range of up to 0.3%, it may not result in a significant increase in properties, but may enhance the ageing response, which is extremely useful for welding.

Iron and silicon can each be present in maximums up to a total of 0.3%. It is preferred that these impurities be present only in trace amounts, limiting the iron to a maximum of 0.15% and the silicon to a maximum of 0.12%, and more preferably to maximums of 0.10% and 0.10%, respectively.

The trace elements sodium and hydrogen are also thought to be harmful to the properties (fracture toughness in particular) of aluminium-magnesium-lithium alloys and should be held to the lowest levels practically attainable, for example on the order of 15 to 30 ppm (0.0015–0.0030%) for the sodium and less than 15 ppm (0.0015%) and preferably less than 1.0 ppm (0.0001%) for the hydrogen. The balance of the alloy, of course, comprises aluminium and incidental impurities. Typically each impurity element is present at 0.05% maximum, and the total of impurities is 0.15% maximum.

The invention further consists in the use of the aluminium-magnesium-lithium product obtained by the method of this for structural components of aircraft such as aircraft skin, and also for the manufacture of aircraft lower wing skins, and can be further used for the skin of aircraft fuselages.

EXAMPLES

The invention will now be illustrated by several non-limitatitive examples.

Example 1

Three ingots have been produced on an industrial scale, of which there are two manufactured in accordance with the invention and one is manufactured for comparison. Three ingots A, B and C (compositions are listed in Table 1) having dimensions 350×1450×2500 mm have been preheated to 395° C. for about 8 hours, and then hot rolled in their width direction to an intermediate thickness of 153 mm followed again by preheating to 395° C. for about 8 hours, and hot rolled in their length direction to an intermediate thickness of 9 mm. Following hot rolling the hot rolled intermediate products are heat treated by holding the product for 100 minutes at 395° C. followed by air cooling. In the next step material from ingot A is cold rolled in width direction in accordance with the invention to an intermediate thickness of 7.6 mm, while material from ingot B is being cold rolled in its length direction to the same intermediate thickness. Subsequently ingot A has been cold rolled in its length direction to an intermediate thickness of 6.1 mm, and then to a final thickness of 4.6 mm. Between the cold rolling step the intermediate products are interannealed at 395° C. for 100 minutes followed by air cooling. Material from ingots B and C have first been cold rolled in their length and width direction respectively from 9 mm to 6.1 mm, heat treated and then cold rolled in its length direction from 6.1 to 4.6 mm. Subsequently both cold rolled material of ingot A and B have been solution heat treated at 530° C. for 1 hours and then cooled to below 150° C. by using air cooling allowing an average cooling rate of about 0.3° C./sec, while the material from ingot C received the same treatment but has been solution heat treated at 480° C. for 1 hour. The cold rolled and solution heat treated sheets have been stretched at room temperature for 0.8% of their original length. Following stretching the sheet products have been aged in a three step ageing heat treatment, consisting of first 6 hours at 85° C., then 12 hours at 120° C. and then 10 hours at 100° C. The processing steps are also summarised in Table 2.

Figure 2:
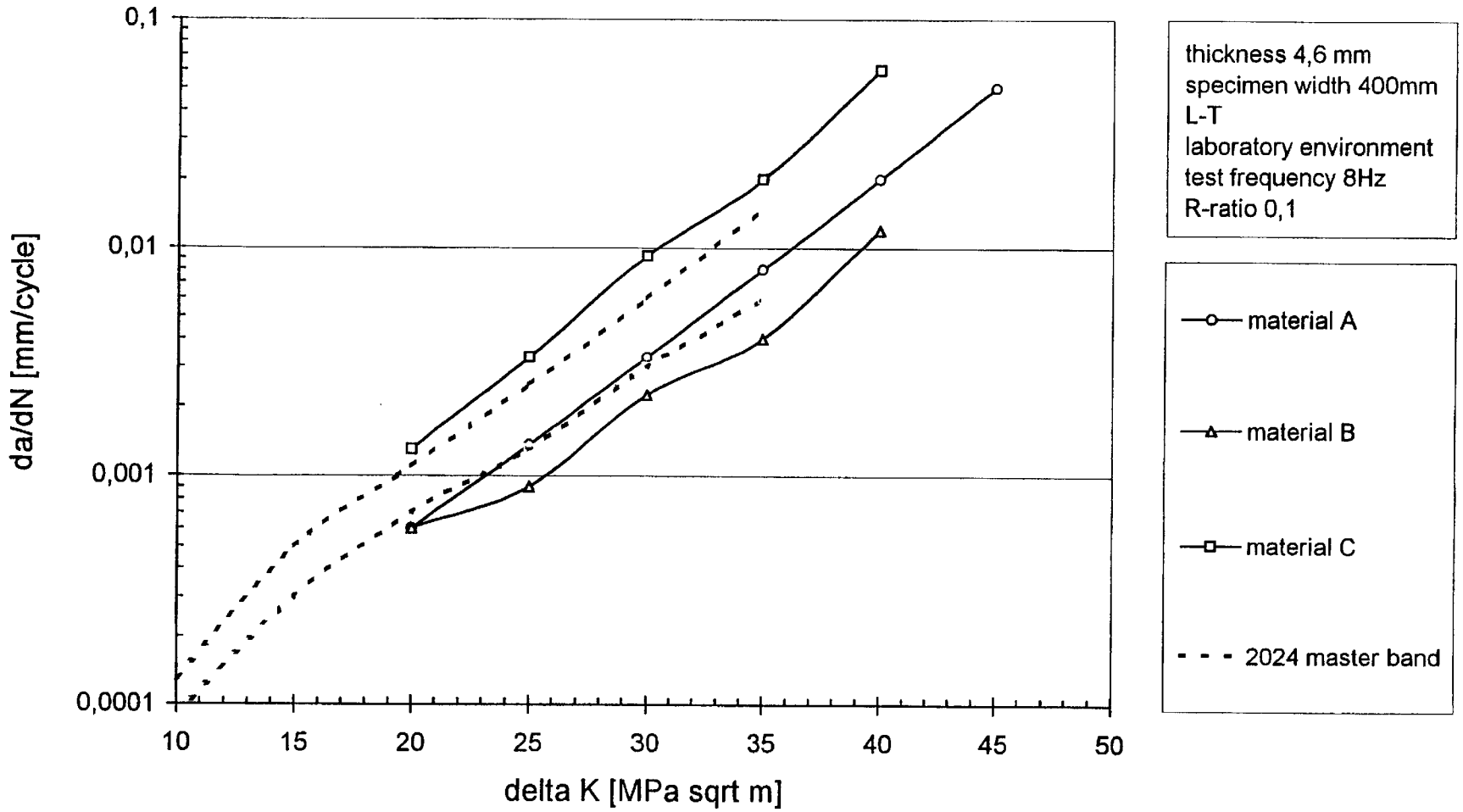

Following ageing the sheets have been tested for their mechanical properties as function of the direction, and for which the results are listed in Table 3 and 4; all results are an average over three specimens tested. For the tensile testing the specimens had dimensions of: $l_o$=50 mm, $b_o$=12.5 mm, and $d_o$=4.6 mm. And further sheets materials have been tested for their crack propagation characteristics, of which the results are shown in FIG. 1 for the T-L direction and compared with the results of the master curve for 2024 material. FIG. 2 shows the crack propagation characteristics for the L-T direction and compared with the results of the master curve for 2024 material. The materials have also been tested for their thermal stability by holding it for 300 hours at 95° C., after which the $K_{CO}$ has been tested in the T-L direction only, the results of which are listed in Table 5. Further the sheet materials have been assessed on the presence of Lüder-lines, and it was found that both sheets materials from ingot A and B were free from both Type-A and type-B Lüder-lines, while material from ingot C showed presence of Type-A Lüder-lines.

From the results from Table 3 it can be seen that the material manufactured in accordance with the invention (ingot A and C) have much more isotropic mechanical properties than the material from ingot B. Further it can be seen that for ingot A and C material the proof strength (PS) are higher for all direction. And the elongation as function of the testing direction are much more balanced with the material from ingots A and C than from material from ingot B, and where the balance for material of ingot A is better than for ingot C material.

From the results from Table 4 it can be seen that the fracture toughness is increased with higher solution heat treatment temperatures. Further it can be seen that material manufactured with the method according to the invention has even a somewhat further improved and more balanced fracture toughness, which is likely to be due to the rolling practice applied.

From the results from Table 5 it can be seen that the material which have been solution heat treated at 530° C. (materials from ingot A and B) have a good thermal stability, the results remain unchanged, while material solution heat treated at 480° C. shows an decrease in $K_{CO}$-value of about 9%.

From the results of FIG. 1 for the critical T-L testing direction, it can be seen that both materials have comparable or better crack propagation characteristics than 2024 material. Further it can be seen that material from ingot A gives better results than material from ingot B. Further it can be seen that for this critical testing direction the resistance to crack propagation is improved with higher solution heat treatment temperatures.

From the results of FIG. 2 for the L-T testing direction, it can be seen that a higher solution heat treatment temperature can significantly improve the crack propagation resistance of the material. In this testing direction the material of ingot B shows better results than material of ingot A and C, which is due to the rolling direction and which is in agreement with expectations.

TABLE 1

| | Composition (weight %) | | | | | | | | |
|---|---|---|---|---|---|---|---|---|---|
| Ingot | Mg | Li | Mn | Fe | Si | Zn | Zr | Sc | Be |
| A + C | 4.90 | 1.65 | 0.18 | 0.08 | 0.05 | 0.59 | 0.08 | 0.08 | 0.001 |
| B | 4.70 | 1.50 | 0.22 | 0.08 | 0.04 | 0.70 | 0.05 | 0.05 | 0.002 |

TABLE 4

| | $K_{CO}$ [MPa. √m] for 400 mm CCT-panels | |
|---|---|---|
| Ingot | L-T | T-L |
| A | 90.9 | 92.7 |
| B | 90.7 | 92.3 |
| C | 83.5 | 86.1 |

TABLE 5

| | $K_{CO}$ [MPa. √m] in T-L for 400 mm CCT-panels | |
|---|---|---|
| Ingot | Before | After |
| A | 92.7 | 92.7 |
| B | 92.3 | 92.3 |
| C | 86.1 | 80.1 |

TABLE 2

| Process step | Ingot A | Ingot B | Ingot C |
|---|---|---|---|
| Preheat | 395° C. for 8 hours | | |
| 1st hot rolling | In width direction to 153 mm | | |
| Preheat | 395° C. for 8 hours | | |
| 2nd hot rolling | In length direction to 9 mm | | |
| Anneal | 395° C. for 100 minutes | | |
| 1st cold rolling | width to 7.6 mm | length to 6.1 mm | width to 6.1 mm |
| Inter-anneal | 395° C. for 100 minutes | | |
| 2nd cold rolling | length to 6.1 mm | length to 4.6 mm | length to 4.6 mm |
| Inter-anneal | 395° C. for 100 min. | — | — |

TABLE 2-continued

| Process step | Ingot A | Ingot B | Ingot C |
|---|---|---|---|
| 3rd cold rolling | length to 4.6 mm | — | — |
| Solution heat tr. | 530° C. for 1 hour | | 480° C. for 1 hour |
| Stretching | 0.8 % of original length | | |
| Ageing | 85° C. for 6 hours/120° C. for 12 hours/100° C. for 10 hours | | |

TABLE 3

| | Ingot A | Ingot B | Ingot C |
|---|---|---|---|
| | PS [MPa] | | |
| L | 346 | 319 | 396 |
| LT | 325 | 306 | 355 |
| 45° | 272 | 231 | 311 |
| | UTS [MPa] | | |
| L | 449 | 476 | 476 |
| LT | 475 | 475 | 488 |
| 45° | 429 | 391 | 449 |
| | Elongation [%] | | |
| L | 7.6 | 8.0 | 5.8 |
| LT | 13.6 | 13.2 | 10.0 |
| 45° | 17.6 | 28.2 | 16.0 |

Example 2

In a similar way as in Example 1 three ingots (ingots D, E and F) have been produced on an industrial scale, of which there is one manufactured in accordance with the invention and two are manufactured for comparison. The chemical composition for all three ingots was the same and is listed in Table 6, and had starting dimensions of 350×1450×2500 mm. The processing route showed similarity with those of Example 1 and are summarised in Table 7. Two different temperatures for the solution heat treatment after cold rolling have been applied, viz. 530° C. and 515° C.

Following ageing the sheets have been tested for their mechanical properties as function of the direction, and for which the results are listed in Table 8 as function of solution heat treatment temperature; all results are an average over three specimens tested. For the tensile testing the specimens had dimensions of: $l_o$=50 mm, $b_o$=12.5 mm, and $d_o$=4.6 mm.

From the results of Table 8 it can be seen that the material manufactured in accordance with the invention (ingot D) has much more isotropic mechanical properties than the material from ingot E and F, more in particular the elongation is much more balanced. Further it can be seen that the method in accordance with the invention results in significantly higher proof strength levels. Further it can be seen from these results than a higher solution heat treatment temperature after cold rolling results in higher mechanical properties after ageing.

TABLE 6

| | Composition (weight %) | | | | | | | | |
|---|---|---|---|---|---|---|---|---|---|
| Ingot | Mg | Li | Mn | Fe | Si | Zn | Zr | Sc | Be |
| D/E/F | 4.85 | 1.60 | 0.22 | 0.09 | 0.05 | 0.70 | 0.07 | 0.07 | 0.001 |

TABLE 7

| Process step | Ingot D | Ingot E | Ingot F |
|---|---|---|---|
| Preheat | 430° C. for 8 hours | | |
| 1st hot rolling | In length direction to 240 mm | | |
| Preheat | 395° C. for 8 hours | | |
| 2nd hot rolling | In width direction to 9 mm | | |
| Anneal | 395° C. for 100 minutes | | |
| 1st cold rolling | width to 7.6 mm | length to 7.6 mm | length to 7.6 mrn |
| Inter-anneal | 395° C. for 100 minutes | | |
| 2nd cold rolling | length direction to 6.1 mm | | length to 4.6 mm |
| Inter-anneal | 395° C. for 100 minutes | | — |
| 3rd cold rolling | length direction to 4.6 mm | | — |
| Solution heat tr. | 515° C. and 530° C. for 1 hour | | |
| Stretching | 0.8% of original length | | |
| Ageing | 85° C. - 6 hours/120° C. - 12 hours/100° C. - 10 hours | | |

TABLE 8

| | Ingot D | | Ingot E | | Ingot F | |
|---|---|---|---|---|---|---|
| | 515° C. | 530° C. | 515° C. | 530° C. | 515° C. | 530° C. |
| | | | PS [MPa] | | | |
| L | 346 | 362 | 298 | 283 | 301 | 289 |
| LT | 315 | 300 | 302 | 299 | 306 | 297 |
| 45° | 264 | 251 | 235 | 222 | 259 | 245 |
| | | | UTS [MPa] | | | |
| L | 412 | 471 | 466 | 460 | 461 | 450 |
| LT | 461 | 453 | 470 | 465 | 464 | 456 |
| 45° | 412 | 403 | 387 | 375 | 421 | 413 |
| | | | Elongation [%] | | | |
| L | 3.4 | 6.5 | 6.8 | 7.8 | 89 | 9.5 |
| LT | 10.3 | 11.1 | 15.1 | 15.6 | 16.3 | 15.4 |
| 45° | 17.3 | 21.9 | 26.6 | 27.8 | 21.0 | 22.2 |

Having now fully described the invention, it will be apparent to one of ordinary skill in the art that many change and modifications can be made thereto without departing from the spirit or scope of the invention as set forth by the claims appended hereto.

What is claimed is:

1. A method for manufacturing an aluminium-magnesium-lithium product, comprising the steps of subsequently:

(a) providing an aluminium alloy consisting essentially of (in weight %):
Mg 3.0–6.0;
Li 0.4–3.0;
Zn up to 2.0;
Mn up to 1.0;
Ag up to 0.5;
Fe up to 0.3;
Si up to 0.3;
Cu up to 0.3; and
0.02–0.5 selected from at least one member from the group consisting of
Sc 0.010–0.40;
Hf 0.010–0.25;
Ti 0.010–0.25;
V 0.010–0.30;
Nd 0.010–0.20;
Zr 0.020–0.25;
Cr 0.020–0.25;
Y 0.005–0.20; and
Be 0.002–0.10;
balance consisting essentially of aluminium and incidental elements and impurities;

(b) casting the aluminium alloy into an ingot;

(c) preheating the ingot;

(d) hot rolling the preheated ingot to a hot worked intermediate product;

(e) cold rolling the hot worked intermediate product to a rolled product in both the length and in the width direction with a total cold rolling reduction of at least 15%;

(f) solution heat treating the cold rolled product in the temperature range of 465 to 565° C. for a soaking time in the range of 0.15 to 8 hours;

(g) cooling the solution heat treated product from the solution heat treatment temperature below 150° C. with a cooling rate of at least 0.2° C./sec; and (h) ageing the cooled product to provide a sheet or thin plate product having a minimum yield strength of at least 260 MPa and a minimum tensile strength at least 400 MPa in at least the L- and LT-direction, a minimum yield strength of at least 230 MPa and a minimum tensile strength of at least 380 MPa in the 45° to the L-direction.

2. The method in accordance with claim 1, wherein the Mg content is in the range of 4.3 to 5.5 weight %.

3. The method in accordance with claim 1, wherein the Li content is in the range of 1.0 to 2.2 weight %.

4. The method in accordance with claim 1, wherein the Zn content is in the range of 0.2 to 1.0 weight %.

5. The method in accordance with claim 1, wherein the aluminium alloy comprises at least Sc in a range of 0.01 to 0.08 weight %.

6. The method in accordance with claim 5, wherein the product further comprises at least Zr in a range of 0.02 to 0.25 weight %.

7. The method in accordance with claim 1, wherein the sheet or thin plate product has a minimum T-L fracture toughness $K_{CO}$ of at least 80 MPa √m for 400 mm wide CCT-panels.

8. The method in accordance with claim 1, wherein during step (d) the preheated ingot is hot rolled in both the length and in the width direction.

9. The method in accordance with claim 8, wherein the Mg content is in the range of 4.3 to 5.5 weight %.

10. The method in accordance with claim 8, wherein the Li content is in the range of 1.0 to 2.2 weight %.

11. The method in accordance with claim 8, wherein the Zn content is in the range of 0.2 to 1.0 weight %.

12. The method in accordance with claim 11, wherein the provided product further comprises at least Zr in a range of 0.02 to 0.25 weight %.

13. The method in accordance with claim 8, wherein the provided aluminium alloy comprises at least Sc in a range of 0.01 to 0.08 weight %.

* * * * *